US011767988B1

(12) United States Patent
Kuster et al.

(10) Patent No.: US 11,767,988 B1
(45) Date of Patent: Sep. 26, 2023

(54) OUTDOOR ENCLOSURE FOR A CIRCULATING PUMP

(71) Applicants: Hans L. Kuster, Barrington, RI (US); Michael McNamara, Coventry, RI (US); John P. Papa, Warwick, RI (US)

(72) Inventors: Hans L. Kuster, Barrington, RI (US); Michael McNamara, Coventry, RI (US); John P. Papa, Warwick, RI (US)

(73) Assignee: AquaMotion, Inc., Barrington, RI (US)

( * ) Notice: Subject to any disclaimer, the term of this patent is extended or adjusted under 35 U.S.C. 154(b) by 929 days.

(21) Appl. No.: 16/521,772

(22) Filed: Jul. 25, 2019

Related U.S. Application Data

(60) Provisional application No. 62/750,509, filed on Oct. 25, 2018.

(51) Int. Cl.
*F04B 53/00* (2006.01)
*F24D 19/00* (2006.01)
*F24D 17/00* (2022.01)

(52) U.S. Cl.
CPC ..... *F24D 19/0095* (2013.01); *F04B 53/00* (2013.01); *F24D 17/0078* (2013.01); *F24D 19/0097* (2013.01)

(58) Field of Classification Search
CPC ..... F24D 19/0095; F24D 17/0078; F24D 19/0097; E03B 7/045; F04D 29/22; F04D 15/0066
See application file for complete search history.

(56) References Cited

U.S. PATENT DOCUMENTS 4,142,515 A * 3/1979 Skaats ..... F24D 17/0031 122/13.3
5,052,904 A * 10/1991 Itakura ..... A01K 63/047 417/413.1
5,905,318 A * 5/1999 Faulhaber ..... H02K 11/22 310/58
6,435,836 B1 * 8/2002 Kobayashi ..... F04D 15/0209 417/32
6,520,745 B1 * 2/2003 Yamamoto ..... F04D 13/06 417/44.1
8,083,500 B1 12/2011 Lebkuchner et al.
8,303,184 B1 11/2012 Lebkuchner et al.
9,328,736 B2 5/2016 Lebkuchner et al.
(Continued)

*Primary Examiner* — Frantz F Jules
*Assistant Examiner* — Martha Tadesse
(74) *Attorney, Agent, or Firm* — Salter & Michaelson

(57) ABSTRACT

The present invention describes a novel outdoor enclosure for circulating pumps for outdoor tankless heaters, outdoor boilers and other outdoor applications. The enclosure includes a body and a cover with the body attaching to the circulator motor. When closed, the enclosure keeps rainfall and other contaminates from entering the wiring space within the enclosure and the circulator motor. The body of the enclosure has multiple ports for electrical wiring inputs for power and for controls connections which can be made with flexible cords and/or hardwires. The outdoor enclosure can be equipped with a terminal strip to simplify wiring and/or with a timer to control when the circulator operates. To avoid problems associated with freezing, the enclosure may include a thermal device that turns the circulator on if temperatures drop. To secure the cover to the body, fastener tabs are included that can accept a screw or lock.

7 Claims, 7 Drawing Sheets

Recirculation System with Outdoor Circulator
On Dedicated Return Line

(56) References Cited

U.S. PATENT DOCUMENTS

| | | | | |
|---|---|---|---|---|
| 9,863,647 | B1 | 1/2018 | McNamara et al. | |
| 9,879,796 | B2 | 1/2018 | Tallos et al. | |
| D834,145 | S | 11/2018 | McNamara et al. | |
| 2009/0211644 | A1* | 8/2009 | Wylie | F24H 1/122 137/337 |
| 2009/0267432 | A1* | 10/2009 | Henry | H02K 5/225 310/71 |
| 2014/0010675 | A1* | 1/2014 | Kent | F04B 43/1238 417/476 |
| 2014/0250580 | A1* | 9/2014 | Magyar | F04D 15/0088 417/63 |
| 2016/0333883 | A1* | 11/2016 | Perrone | F04D 29/22 |

* cited by examiner

OUTDOOR ENCLOSURE FOR A CIRCULATING PUMP

RELATED CASE

Priority for this application is hereby claimed under 35 U.S.C. § 119(e) to commonly owned and U.S. Provisional Patent Application No. 62/750,509 which was filed on Oct. 25, 2018 and which is incorporated by reference herein in its entirety.

FIELD OF INVENTION

The present invention relates to an enclosure for a circulating pump system. More particularly, the present invention relates to a novel apparatus for enclosing an electrical box associated with a circulating pump to allow the circulating pump to be used outdoors, while protecting the circulator pump from freezing in the outdoor atmosphere.

BACKGROUND OF THE INVENTION

Currently circulating pumps are generally approved only for indoor applications. There are several applications which would benefit if circulating pumps could be used outdoors in locations were wind, cold and rain would present problems. One application would be outdoor wood boilers which are generally located some distance from the structure they are heating to minimize problems that can occur from exhaust smoke and fumes. Another application is as hot water circulation or recirculation pumps on outdoor energy saving tankless heater applications which are becoming increasingly popular in the southern states and states, particularly in the Southwest. This popularity of outdoor tankless heaters is driven by interior space savings and dollar savings that are realized by eliminating vent pipes and the need for vent piping exits through building structure. A major drawback to placing circulating pumps outside has also been the problems associated with freezing which can not only damage the circulator but also lead to leaks and water damage.

A number of tankless heater manufacturers offer built in circulators that are protected from the weather by the tankless enclosure itself and protected from freezing by heaters that are disposed within the tankless enclosure. These circulators have many limitations. Due to their location inside the heater enclosure, servicing them requires the tankless enclosures to be removed. The limited and cramped space within the enclosures allows little or no space to remove or service these circulators without further disassembly of the tankless heater. The selection and sizing of circulators to match system requirements is limited or nonexistent with built in circulators since the model offerings of the tankless heaters would expand dramatically if full ranges of circulators were to be offered.

Accordingly, it is an object of the present invention to provide an external pump that provides homeowners with a larger choice of more competitive tankless heater offerings.

Another object of the present invention is to provide a free-standing circulating pump enclosure that is constructed for outdoor use while being freeze proof.

Still another object of the present invention is to provide a circulating pump enclosure that also contains a self-contained timer for controlling the circulating pump.

SUMMARY OF THE INVENTION

The present invention comprises a novel enclosure that not only protects the electrical components of the circulator from rain but also is secured to prevent wind from opening the enclosure. The enclosure structure is such that a timer and/or thermostat can be housed and protected within the enclosure to control the operation of the circulator. Multiple electrical entries through the enclosure allow cord connections or hard wire connections for direct power and/or for power to be supplied by the tankless heater or other devices. Additional entry ports allow for other control devices such as thermostats to be wired or terminated in the enclosure. The mounting of the enclosure on the circulator motor allows the circulator flow housing to be rotated into multiple flow directions while maintaining the enclosure in a position that withstands rainfall and other hazardous weather conditions.

In accordance with the present invention there is provided an outdoor enclosure for use with a circulating pump that is associated with an outdoor water heater. The outdoor enclosure comprises an enclosure body; an enclosure cover; the enclosure body having one or more entry ports for receiving an electrical connection cord; fasteners for mounting the enclosure body to the circulating pump; means for interconnecting the enclosure body and the enclosure cover including a securing member to maintain the enclosure cover to the enclosure body; and the enclosure body and enclosure cover providing an inner space for accommodating electrical power and control wiring.

In accordance with other aspects of the present invention including an internally mounted terminal strip disposed within said space to connect the external incoming power and control wiring with the circulating pump; including a timer partially or completely enclosed within the space provided between the enclosure body and the enclosure cover; wherein the timer has a clear cover or lid through which a timer setting can be viewed; wherein the circulator body through which the fluid being pump flows is allowed to be rotated into various positions without changing the orientation of the outdoor enclosure and it's ability to resist rainfall; including a thermal device within the space that will allow the circulator motor to start when a specific lower temperature occurs thereby protecting the circulator motor from freezing by means of the heat generated from the running circulator motor; including one or more a filters disposed within the enclosure to allow air passage and to keep dust dirt and insects out of the outdoor enclosure; wherein the enclosure body as an outlet port through which water can drain; wherein there is also included a filter at the outlet port; including a gasket that is disposed between the enclosure body and the enclosure cover; wherein the circulator pump has a cylindrical shape and the enclosure body has an arcuate rear wall that matches the cylindrical circulator shape; including a gasket that is disposed between the circulator pump and the rear wall of the enclosure body; including a timer partially or completely enclosed within the space provided between the enclosure body and the enclosure cover; and a timer enclosure for accommodating the timer; wherein the timer enclosure is comprised of a timer housing base and a timer housing cover; and including first fasteners for securing the timer housing base to the enclosure body and third fasteners for securing the timer housing base with the timer housing cover.

In accordance with another embodiment of the present invention there is provided an outdoor enclosure for use with a circulating pump, said outdoor enclosure comprising: an enclosure body; an enclosure cover; the enclosure body having one or more entry ports for receiving an electrical connection cord; fasteners for mounting the enclosure body to the circulating pump; means for interconnecting the enclosure body and the enclosure cover including a securing member to maintain the enclosure cover to the enclosure body; and the enclosure body and enclosure cover providing an inner space for accommodating electrical power and control wiring.

In accordance with still other aspects of the present invention wherein the means for interconnecting the enclosure body and the enclosure cover includes a hinge pin; wherein the means for interconnecting the enclosure body and the enclosure cover includes mating securing mechanism without hinging; wherein the enclosure body as an outlet port through which water can drain; and including a timer partially or completely enclosed within the space provided between the enclosure body and the enclosure cover; and a timer enclosure for accommodating the timer.

BRIEF DESCRIPTION OF THE DRAWINGS

Some embodiments of the present invention are illustrated as an example and are not limited by the figures of the accompanying drawings, in which like references may indicate similar elements and in which.

DETAILED DESCRIPTION OF THE INVENTION

The terminology used herein is for the purpose of describing particular embodiments only and is not intended to be limiting of the invention. As used herein, the term "and/or" includes any and all combinations of one or more of the associated listed items. As used herein, the singular forms "a", "an", and "the" are intended to include the plural forms as well as the singular forms, unless the context clearly indicates otherwise. It will be further understood that the terms "comprises" and/or "comprising", when used in this specification, signify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the present invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

Novel outdoor enclosures for circulating pumps for use with outdoor tankless heaters, wood boilers and other outdoor equipment is discussed herein. In the following description, for purposes of explanation, numerous specific details are set forth in order to provide a thorough understanding of the present invention. The present disclosure is to be considered as an exemplification of the invention and is not intended to limit the invention to the specific embodiments illustrated by the figures or description below. The present description will now be described by referencing the appended figures representing preferred embodiments of the present invention.

Figure 1:
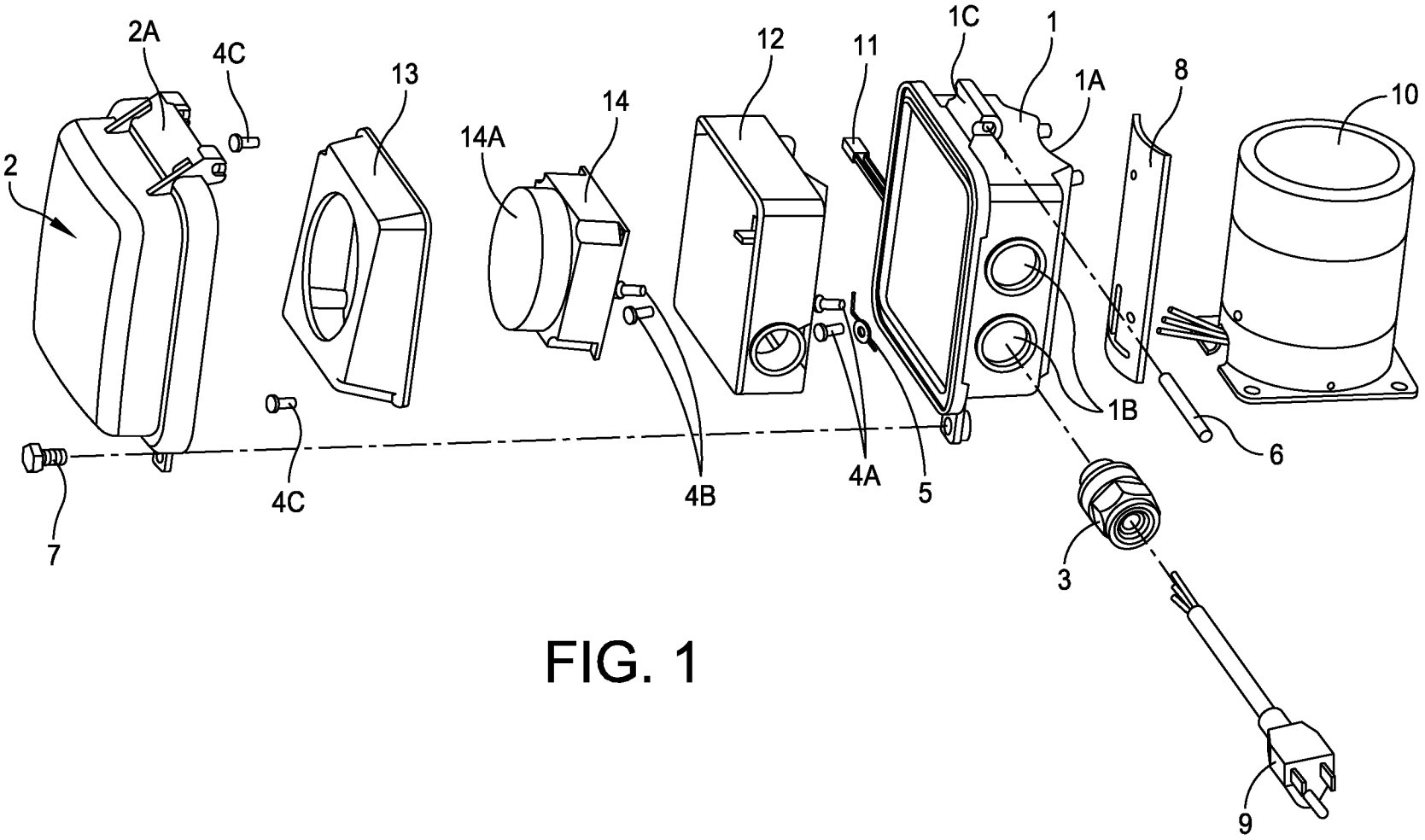
FIG. 1 depicts an exploded view of one example of the enclosure of the present invention, also showing a timer according to various embodiments of the present invention.

FIG. 1 depicts an exploded view of the elements that may comprise an outdoor enclosure with a timer 14 and thermostat 11 according to various embodiments of the present invention. In preferred embodiments the elements of the outdoor enclosure are contained in or are attached to the enclosure body 1 and the enclosure cover 2. The enclosure body 1 is attached directly to the circulator motor 10 by means of screws 4A and washers 5. Sealing between the enclosure body 1 and the circulator motor 10 is by means of an enclosure gasket 8. The enclosure cover is pivotally attached to the enclosure body with a hinge pin 6. When the enclosure cover 2 is closed a screw 7, or a series of screws secures the enclosure cover 2 to the enclosure body 1.

The body 1, as shown in FIG. 1, has a curved side at 1A that matches the diameter of the circulator motor 10. The screws 4A may be provided in sets and are adapted to pass through the inner end wall of the housing 1, through the gasket 8 and into an outer housing of the circulator motor 10. The housing 1 also has at least two side disposed ports 1B. On the top surface of the housing 1 there is provided a flange 1C for receiving the hinge pin 6. One or more screws 7 may be used to secure the enclosure cover 2 with the enclosure base 1. The enclosure cover 2 is also provided with a flange set 2A that is adapted to mate with the flange 1C at the top wall of the housing base or body 1. The hinge pin passes through both flanges 1C and 2A.

The timer 14 is enclosed between the timer base 12 and the timer base cover 13. The timer 14 is provided with a face 14A where the selected time can be observed. The timer base 12 is attached to the enclosure body 1 by means of screws 4B and the timer base cover 13 is attached to the timer base with screws 4C. Multiple screws 4B and 4C may be provided. Each of the screws is adapted to pass through a cover or base in a manner to removably secure the parts together. Wiring (not shown) of the circulator motor 10, power cord 9 and thermostat 11 is arranged within the timer base 12 and timer base cover 13. The power cord 9 enters the enclosure body 1 through a water tight cord connector 3 at one of the ports 1B.

Figure 2:
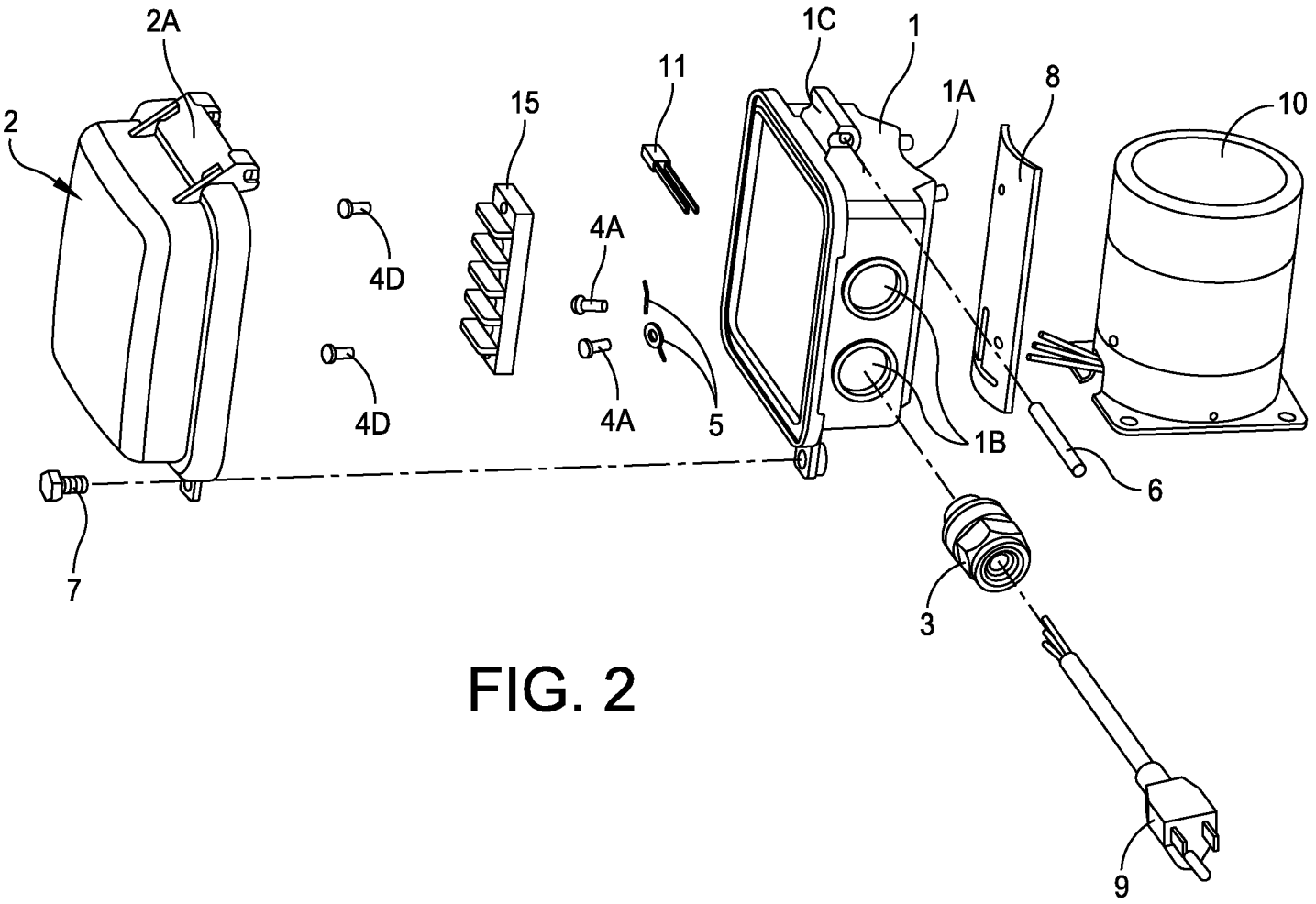
FIG. 2 depicts an exploded view of one example of the enclosure of the present invention without a timer according to various embodiments of the present invention.

Referring now to FIG. 2 there is depicted an exploded view of the elements that may comprise an outdoor enclosure with a thermostat and without a timer according to various embodiments of the present invention. In preferred embodiments the elements of the outdoor enclosure are contained in or are attached to the enclosure body 1 and the enclosure cover 2. The enclosure body 1 is attached directly to the circulator motor 10 by means of screws 4A and washers 5, an in the first embodiment shown in FIG. 1. Sealing between the enclosure body 1 and the circulator motor 10 is by means of an enclosure gasket 8. The enclosure cover 2 is attached to the enclosure body with a hinge pin 6, as in FIG. 1. When the enclosure cover 2 is closed one or more screws 7 secure the enclosure cover 2 to the enclosure body 1.

In FIG. 2 there is shown a terminal strip 15 that may be secured to the enclosure body 1 by means of screws 4D. The circulator motor 10, power cord 9 and thermostat 11 are connected to the terminal strip 15. A similar terminal strip may also be associated with the embodiment shown in FIG. 1.

Figure 3:
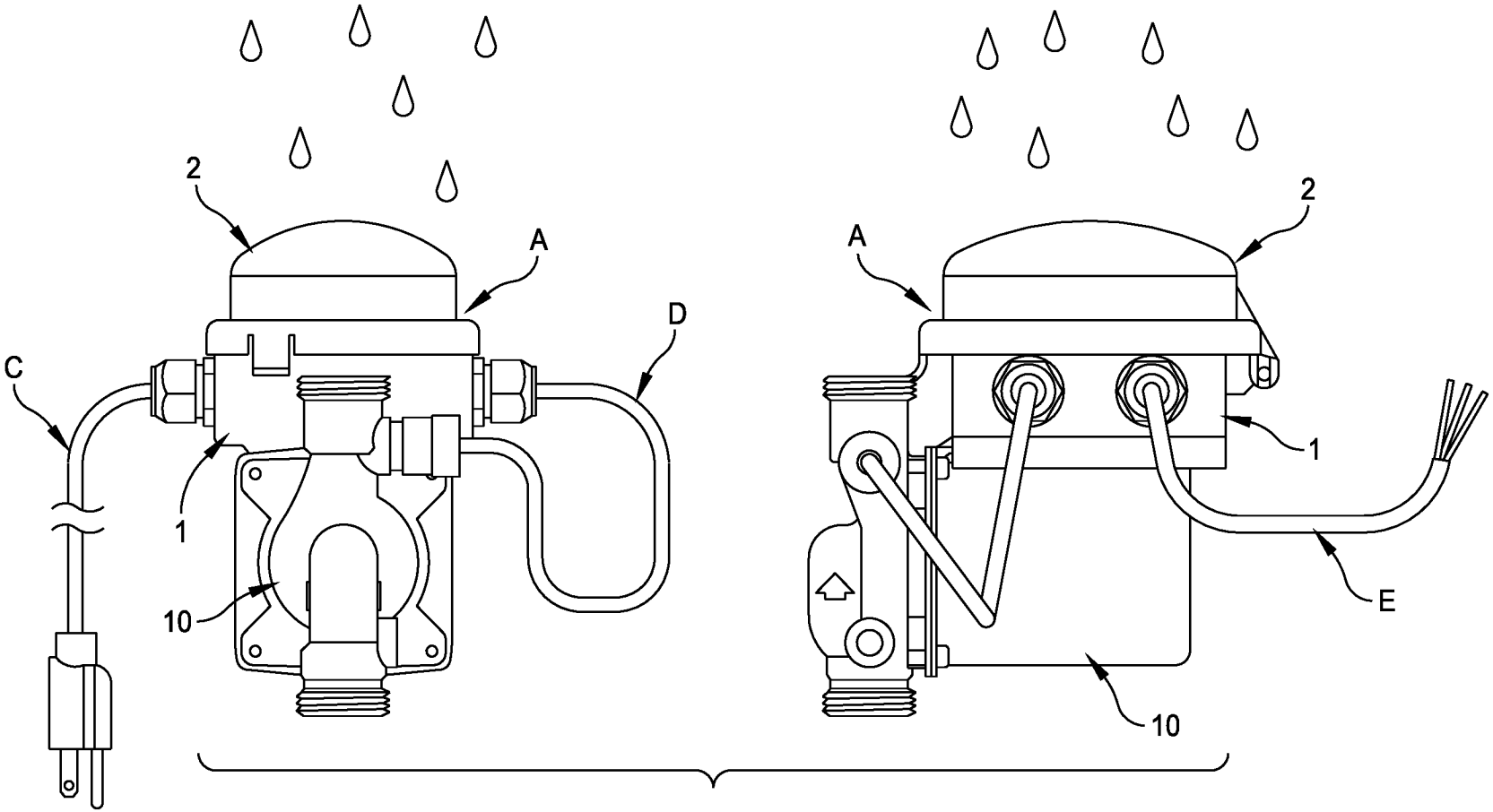
FIG. 3 shows the enclosure with electrical entries for power and control cords.
Figure 4:
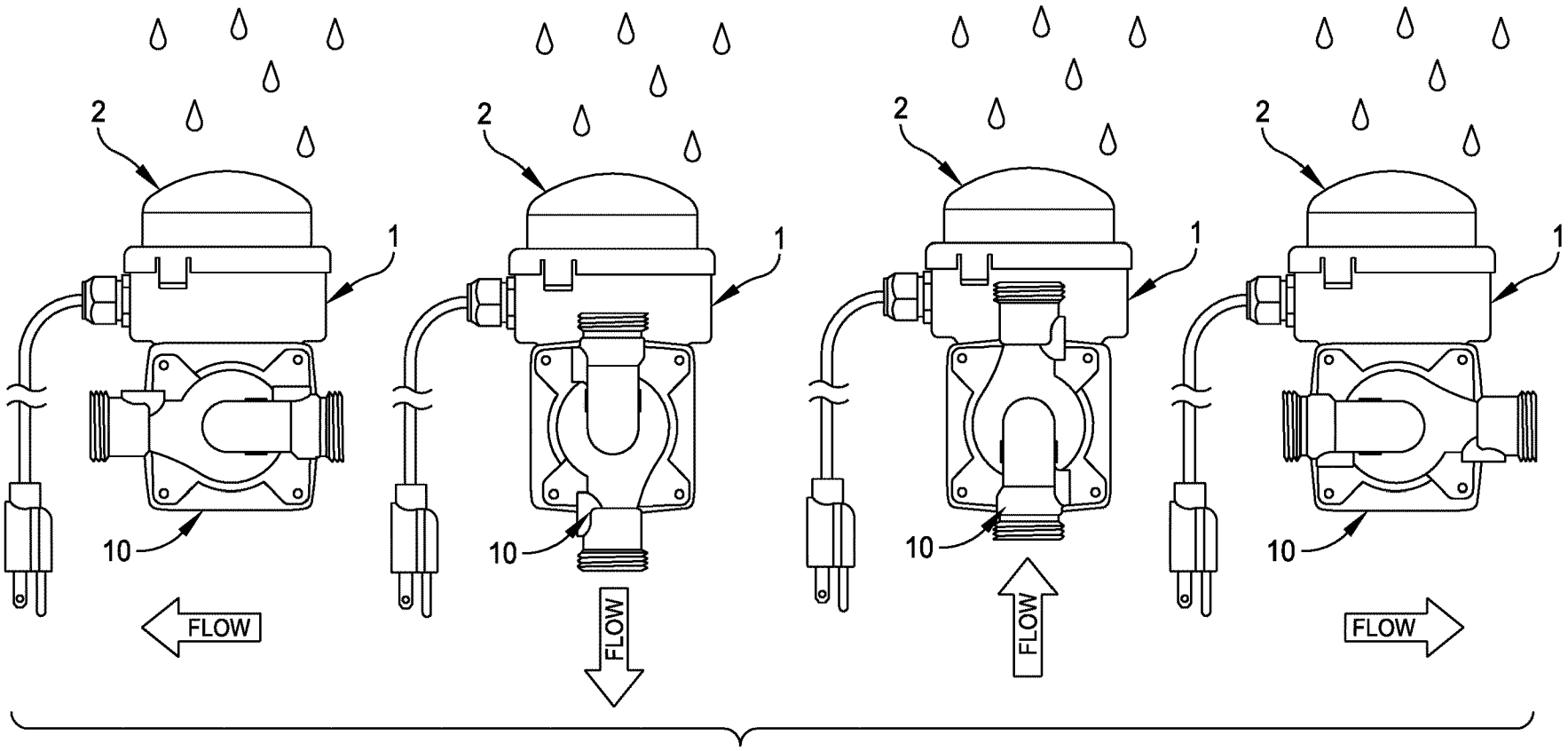
FIG. 4 illustrates the various flow directions of the circulator that maintain the enclosure in an upright rain resistant position.

Reference is now made to FIG. 3 which illustrates the connections to the outdoor enclosure body A via the power cord C with an attached plug. This power cord is used for powering the circulator 10 directly from a wall outlet and/or when powering the freeze protection thermostat 11. If an external control or thermostat is used to turn on and off a separate cord D is used to make or break the power to the circulator. If the power and/or control for the circulator is managed by a tankless heater or other device another cord set E may be used. Wiring can be either by flexible cords or hardwired. Reference is now made to FIG. 4 wherein the outdoor enclosure is shown with various flow directions while maintaining an upward facing orientation to resist rain fall. In FIGS. 3 and 4 the enclosure body A is mounted on the circulator motor 10. In this way the circulator flow housing 18 is allowed to rotate into multiple flow directions, indicated by the flow arrows in FIG. 3, while maintaining the enclosure in an upright position that withstands rainfall and other hazardous weather conditions in the various rotational positions on the flow housing 18. In this regard FIGS. 3 and 4 illustrate the various rotational positions wherein the enclosure cover 2 is always in an upward facing position.

Figure 5:
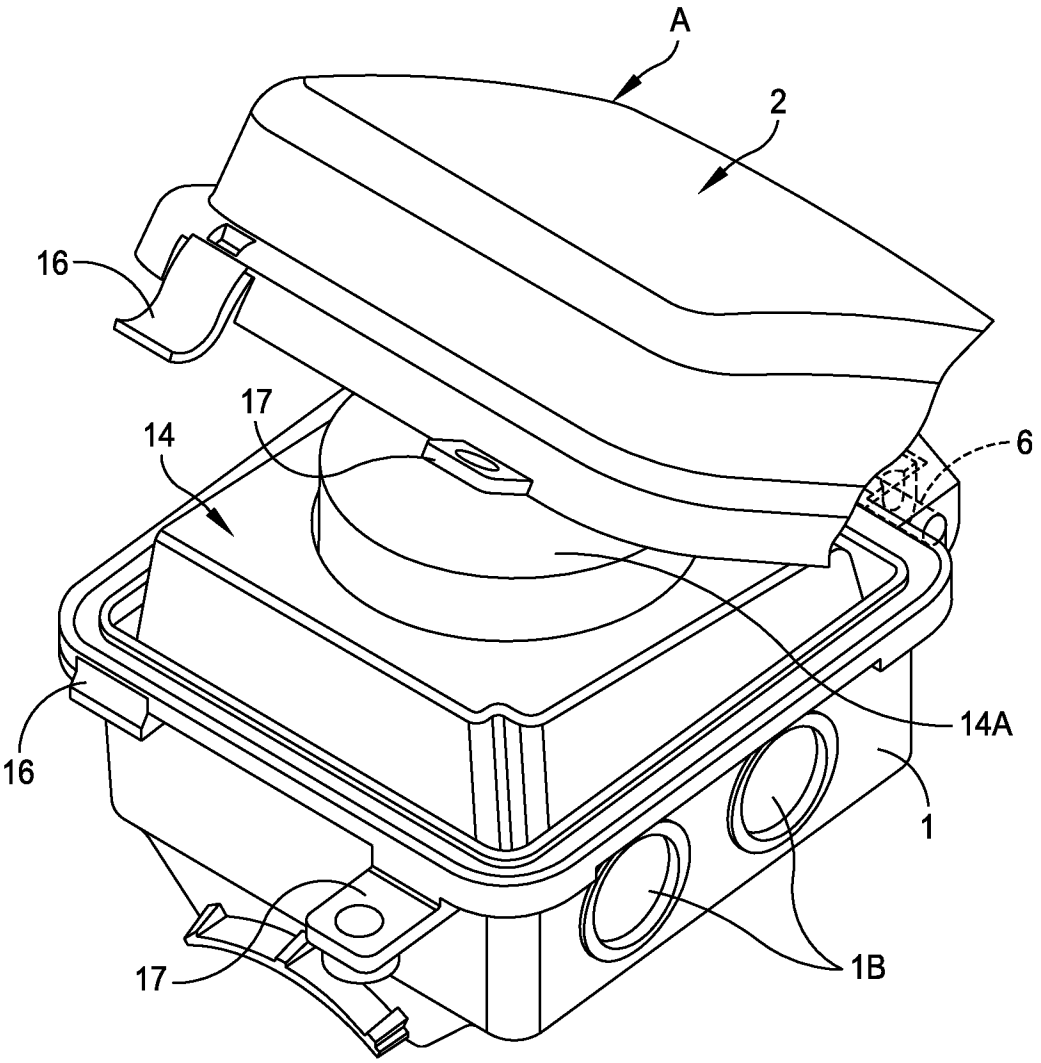
FIG. 5 shows the enclosure with the cover in an open position.
Figure 7:
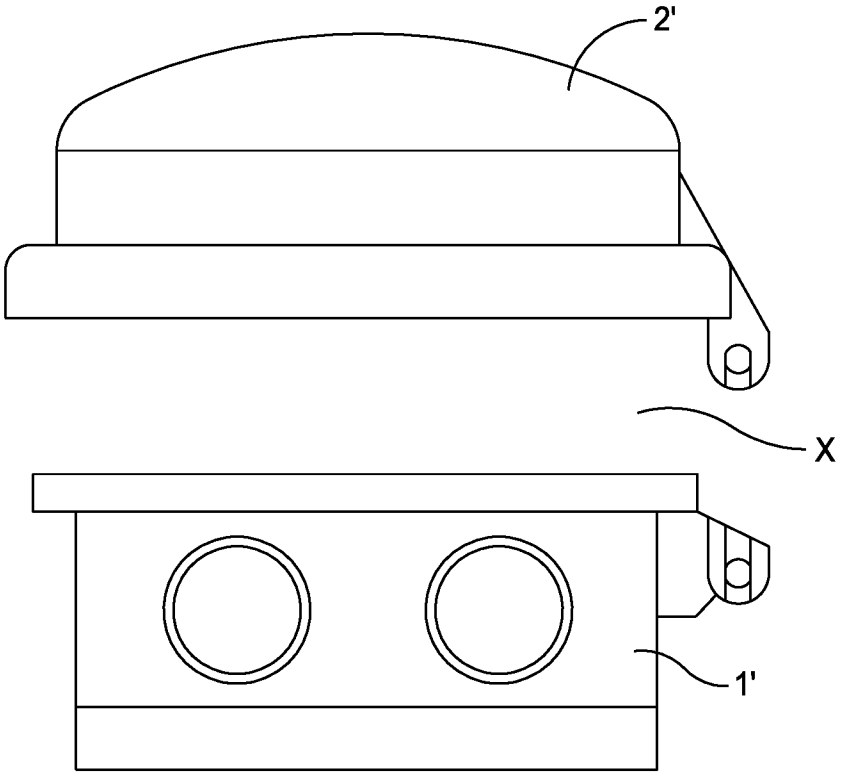
FIG. 7 is a simple schematic diagram showing an alternative mechanism for securing the base and cover using a snap fit arrangement in place of a hinge.

Reference is now made to FIG. 5 wherein the outdoor enclosure with a timer 14 is shown in an open position exposing the timer face 14A. The face 14A of the timer 14 preferably has a clear cover or lid through which a timer setting can be viewed. A clip latch 16 is used to open/close the outdoor enclosure and locking tabs 17 are used to secure the cover with a screw or lock. FIG. 5 shows the enclosure cover 2 in at least a partially open position so that the face of the timer is visible. Reference is also made to the schematic diagram of FIG. 7 that shows an alternate base and cover arrangement that does not employ a hinge pin but instead provides a snap fit at X between the base 1' and the cover 2'.

Figure 6:
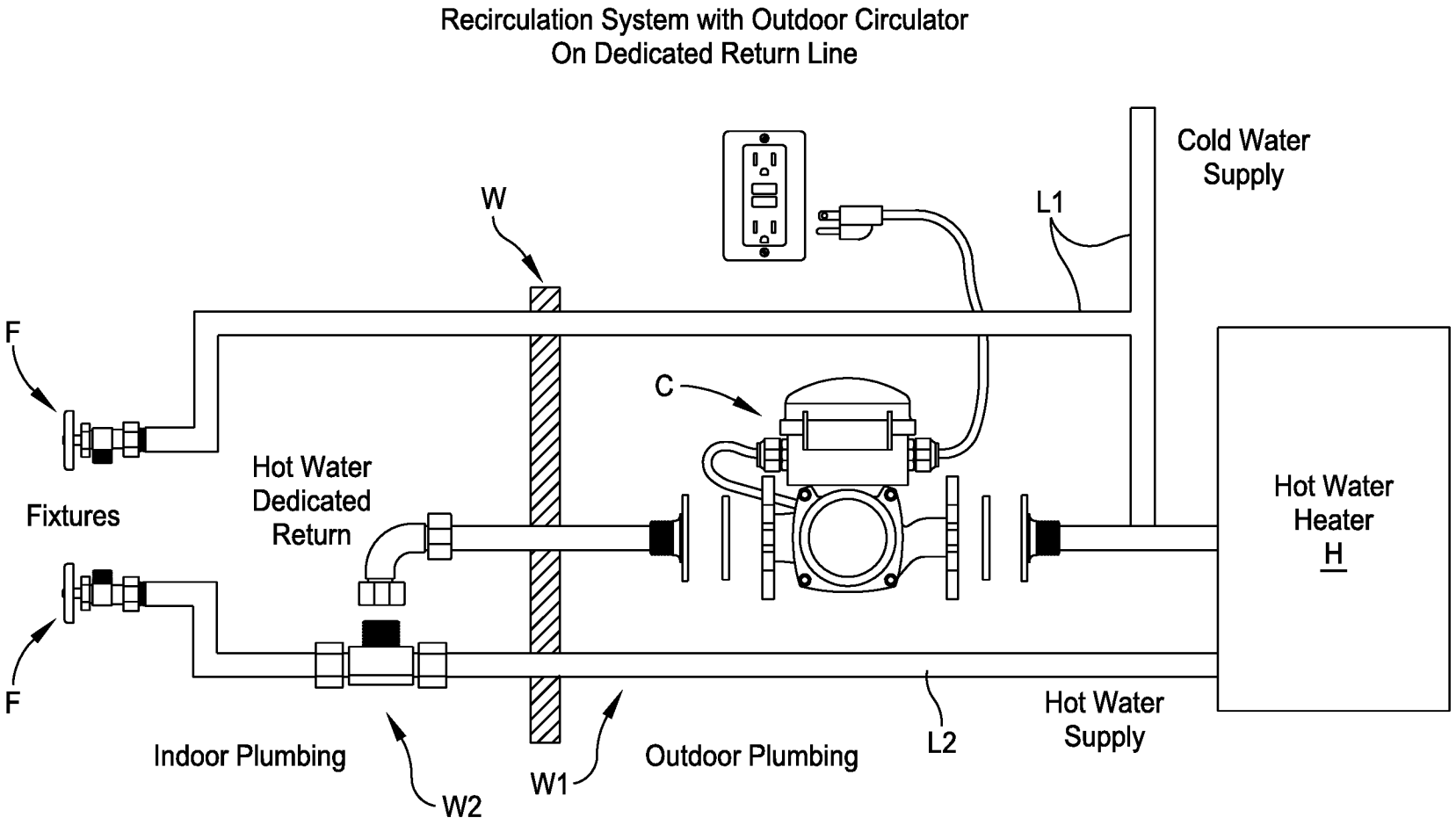
FIG. 6 illustrates a complete recirculation system including the outdoor circulator and hot water heater.

Reference is now made to FIG. 6 for an illustration of a complete recirculation system that employs an outdoor circulator C. The diagram of FIG. 6 by means of the wall W defines a demarcation between outdoor plumbing at W1 and indoor plumbing at W2. FIG. 6 also indicates the hot water heater 8 which may be a tankless heater or any other type of water heater. FIG. 6 also illustrates by lines L1 the cold water connection and by lines L2 the hot water connection. The fixtures are schematically illustrated at F.

While preferred materials of construction for the elements have not been described, the present invention may be constructed of but not limited to metal alloys, plastic, glass, rubber, foam, composites and other materials. These materials may comprise some or all of the elements of the present invention.

Although the present invention has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention, are contemplated thereby, and are intended to be covered by the following claims.

What is claimed is:

1. A recirculation system that is comprised of: an outdoor circulator; a demarcation wall that defines respective indoor and outdoor plumbing areas; a hot water heater that is disposed in the outdoor plumbing area; the outdoor circulator being disposed in the outdoor plumbing area; a hot water supply line from the hot water heater; a cold water supply line to the hot water heater; a hot water dedicated return line that includes a first segment line that connects the cold water supply line with an input of the outdoor circulator, and a second segment line that connects from an output of the outdoor circulator; respective hot and cold fixtures disposed in the indoor plumbing area; the hot water supply line running through the demarcation wall between the outdoor and indoor plumbing areas to the hot water fixture; the cold water supply line running through the demarcation wall between the outdoor and the indoor plumbing areas to the cold water fixture; and the second segment line of the hot water dedicated return line running through the demarcation wall between the outdoor and indoor plumbing areas; wherein the outdoor circulator includes: an enclosure body, an enclosure cover; a circulating pump; the enclosure body having one or more entry ports for receiving an electrical connection cord, fasteners for mounting the enclosure body to the circulating pump, a securing member for securing the enclosure cover to the enclosure body, the enclosure body and the enclosure cover providing an inner space for accommodating electrical power and control wiring; and a tee connection in the indoor plumbing area having opposed ends defining a through connection connecting respectively to the hot water supply line, and to the hot water fixture, the tee connection further having a direct side connection that is connected to the second segment line of the hot water dedicated return line.

2. The recirculating system of claim 1 including an internally mounted terminal strip disposed within said inner space to connect the electrical power and control wiring with the circulating pump.

3. The recirculating system of claim 2 including a timer partially or completely enclosed within the inner space provided between the enclosure body and the enclosure cover.

4. The recirculating system of claim 3 wherein the timer has a clear cover or lid through which a timer setting can be viewed.

5. The recirculating system of claim 1 including a gasket that is disposed between the enclosure body and the enclosure cover.

6. The recirculating system of claim 1 wherein the circulating pump has a cylindrical shape and the enclosure body has an arcuate rear wall that matches the cylindrical shape.

7. The recirculating system of claim 6 including a gasket that is disposed between the circulating pump and a rear wall of the enclosure body.

* * * * *